US007086356B2

(12) United States Patent
Matsuda

(10) Patent No.: US 7,086,356 B2
(45) Date of Patent: Aug. 8, 2006

(54) ENGINE COOLING STRUCTURE

(75) Inventor: Minoru Matsuda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/896,283

(22) Filed: Jul. 22, 2004

(65) Prior Publication Data

US 2005/0056237 A1 Mar. 17, 2005

(30) Foreign Application Priority Data

Jul. 24, 2003 (JP) ..... 2003-279248

(51) Int. Cl.
*F02F 1/14* (2006.01)

(52) U.S. Cl. ..... 123/41.72; 123/41.74

(58) Field of Classification Search ..... 123/41.72, 123/41.74

See application file for complete search history.

(56) References Cited

U.S. PATENT DOCUMENTS

| | | | | |
|---|---|---|---|---|
| 754,418 A | | 3/1904 | Brennan | |
| 3,757,747 A | * | 9/1973 | Hartmann | 123/41.74 |
| 4,312,304 A | * | 1/1982 | Tyner | 123/41.74 |
| 4,369,739 A | * | 1/1983 | Umemura et al. | 123/41.74 |
| 4,455,972 A | * | 6/1984 | Kawakami | 123/41.74 |
| 4,601,265 A | * | 7/1986 | Wells et al. | 123/41.28 |
| 4,741,293 A | * | 5/1988 | Itoh et al. | 123/41.79 |
| 5,076,217 A | * | 12/1991 | Clough | 123/41.74 |
| 5,357,910 A | * | 10/1994 | Wenger et al. | 123/41.74 |
| 5,699,760 A | * | 12/1997 | Yang et al. | 123/41.74 |
| 6,202,603 B1 | * | 3/2001 | Etemad | 123/41.74 |
| 6,408,803 B1 | | 6/2002 | Atkins | |
| 6,481,392 B1 | * | 11/2002 | Etemad | 123/41.74 |

FOREIGN PATENT DOCUMENTS

| | | |
|---|---|---|
| DE | 36 43 674 A1 | 6/1988 |
| GB | 856 616 A | 12/1960 |
| JP | 2000-161062 A | 6/2000 |

* cited by examiner

*Primary Examiner*—Noah P. Kamen
*Assistant Examiner*—Jason Benton
(74) *Attorney, Agent, or Firm*—Birch, Stewart, Kolasch & Birch, LLP

(57) ABSTRACT

To simplify a coolant piping around an engine in an engine cooling structure, which has a pump mounted on a crankcase for circulating a coolant between cylinder and head jackets. A crankcase has coolant supply passages for guiding a coolant from a pump and coolant return passages for guiding a coolant delivered out of cylinder jackets. The coolant supply passages and the coolant return passages extend substantially parallel to the axis of a crankshaft. The cylinder jackets and head jackets are formed wherein the coolant supplied from the coolant supply passages returns from the cylinder jackets via the head jackets to the cylinder jackets.

16 Claims, 11 Drawing Sheets

ENGINE COOLING STRUCTURE

CROSS-REFERENCE TO RELATED APPLICATIONS

The present application claims priority under 35 USC 119 to Japanese Patent Application No. 2003-279248 filed on Jul. 24, 2003 the entire contents thereof is hereby incorporated by reference.

BACKGROUND OF THE INVENTION

1. Field of the Invention

The present invention relates to an engine cooling structure in which cylinder barrels having cylinder bores and cooling cylinder water jackets are coupled to a crankcase with a crankshaft rotatably supported therein. Cylinder heads are provided having head water jackets communicating with the cylinder water jackets and are coupled to the cylinder barrels with combustion chambers defined between the cylinder heads and the cylinder barrels. Pistons are slidably fitted in the cylinder bores with top ends facing the combustion chambers. A water pump is provided for circulating a coolant between the cylinder and head water jackets and is mounted on the crankcase on one end thereof along the axis of the crankshaft.

2. Description of Background Art

An engine is known wherein a water pump is mounted on an end of a crankcase along the axis of a crankshaft, for supplying a coolant to water jackets of cylinder barrels coupled to the crankcase. See, for example Japanese Patent Laid-open No. 2000-161062.

In the above conventional structure, the water pump and the cylinder barrels are connected by conduits, which supply water from the water pump to cylinder water jackets. In addition, conduits for delivering out the coolant, which flows from the cylinder water jackets into head jackets, are connected to a head cover. Therefore, the coolant piping around the engine is complex. In particular, the coolant piping is more complex if incorporated in a horizontally opposed engine because a pair of conduits for guiding the coolant from the water pump is connected to the water pump and conduits for delivering out the coolant are connected respectively to cylinder heads on both sides of the crankcase.

SUMMARY AND OBJECTS OF THE INVENTION

The present invention has been made in view of the above problems. It is an object of the present invention to provide an engine cooling structure having a simplified coolant piping around an engine.

To achieve the above object, there is provided in accordance with the present invention an engine cooling structure in which cylinder barrels having cylinder bores and cooling cylinder water jackets are coupled to a crankcase with a crankshaft rotatably supported therein. Cylinder heads are provided having head water jackets communicating with the cylinder water jackets that are coupled to the cylinder barrels with combustion chambers defined between the cylinder heads and the cylinder barrels. Pistons are slidably fitted in the cylinder bores with top ends facing the combustion chambers. A water pump is provided for circulating a coolant between the cylinder and head water jackets and is mounted on the crankcase on one end thereof along the axis of the crankshaft. The crankcase has coolant supply passages for guiding the coolant from the water pump and coolant return passages for guiding the coolant led from the cylinder water jackets. The coolant supply passages and the coolant return passages extend parallel to the axis of the crankshaft with the axes of the cylinder bores being disposed therebetween. The cylinder water jackets and the head water jackets are formed such that the coolant supplied from the coolant supply passages returns from the cylinder water jackets through the head water jackets to the cylinder water jackets.

In addition the present invention provides cylinder water jackets that are formed in the cylinder barrels so as to be divided into a supply jacket portion communicating with the coolant supply passages and communicating with the head water jackets and a return jacket portion communicating with the coolant return passages and communicating with the head water jackets at a position spaced from the supply jacket portion.

In addition, the present invention provides the supply jacket portion and the return jacket portion with superposed portions surrounding substantial half of the cylinder bores and being formed in the cylinder barrels having the cylinder bores arrayed in the axial direction of the crankshaft. A plurality of supply and return branch passages are provided which connect the regions of the supply jacket portion and the return jacket portion that correspond to the cylinder bores to the coolant supply passages and the coolant return passages and being disposed in the crankcase and the cylinder barrels.

In addition, the present invention provides the cylinder barrels and the cylinder heads that are integrally formed by mutually joining the cylinder water jackets and the head water jackets.

In addition the present invention provides rod members for dividing ring-shaped cavities which are defined in the cylinder barrels in a surrounding relationship to the cylinder bores in a casting process and being disposed halfway into the supply and return jacket portions that are fitted into cylinder barrels from the cylinder heads.

According to the present invention, no piping is required outside of the engine for guiding the coolant from the water pump to the cylinder barrels, and no piping is required outside of the engine for delivering out the coolant from the cylinder heads. Therefore, the coolant piping around the engine is simplified.

According to the present invention, the coolant supply passages and the coolant return passages can be cast or drilled in one direction along the axis of the crankshaft. Therefore, the machinability for forming the passages is increased.

According to the present invention, a passage structure for uniformly cooling portions corresponding to the respective cylinder bores in a multicylinder engine can easily be constructed.

According to the present invention, a sand core in the shape of a succession of the cylinder and head water jackets is integrally formed for increased productivity for the cylinder barrels and the cylinder heads.

According to the present invention, portions of the sand core, which correspond to the cylinder bores of the cylinder jackets, are ring-shaped for easy sand removal to increase productivity and castability. In addition, the cylinder water jackets can easily be divided into a supply jacket portion and a return jacket portion.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Embodiments of the present invention will be described below with reference to the accompanying drawings.

FIGS. 1 through 10 show a first embodiment wherein the present invention is applied to a four-cycle horizontally opposite four-cylinder engine.

Figure 1:
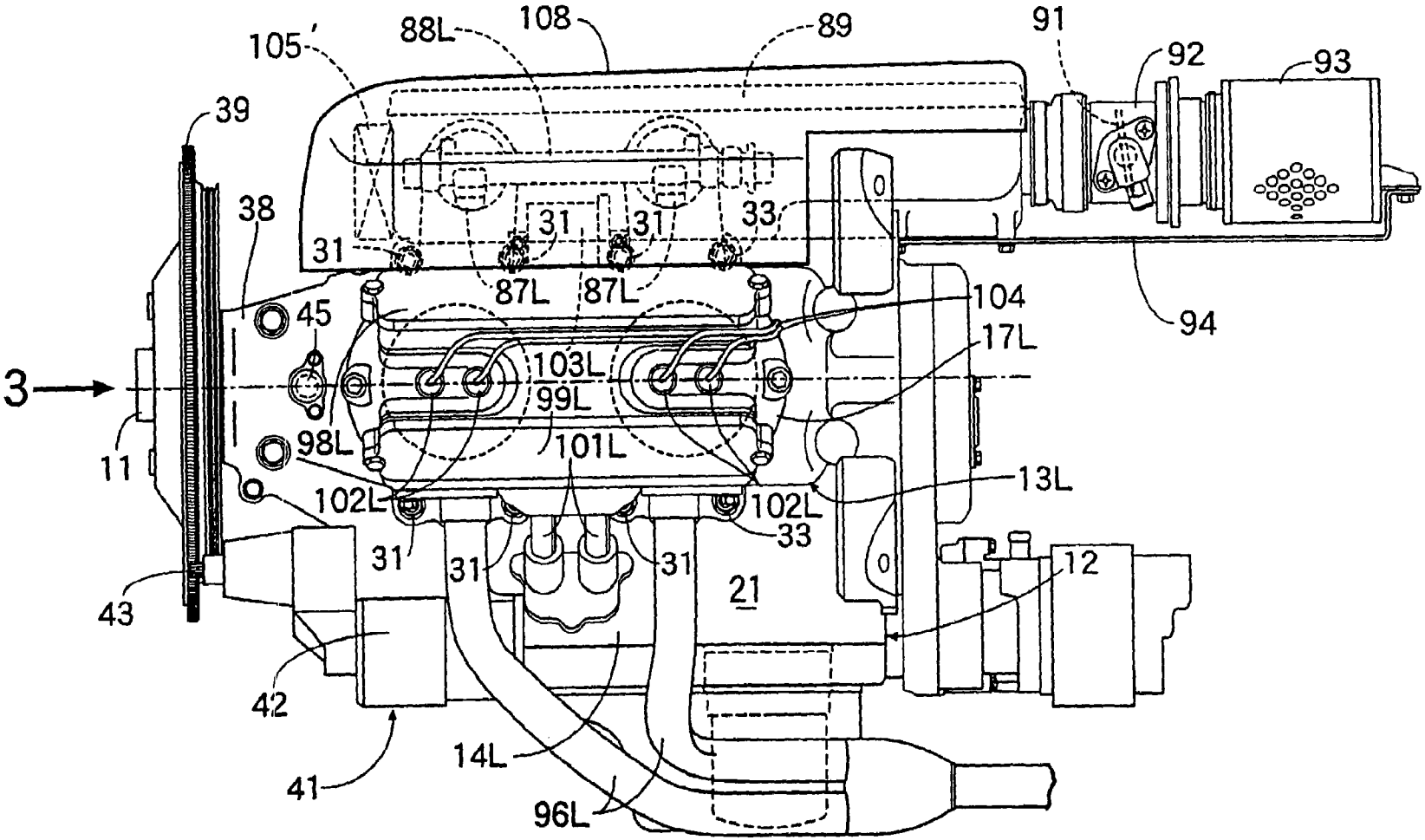
FIG. 1 is a side elevational view of the engine showing a first embodiment.
Figure 2:
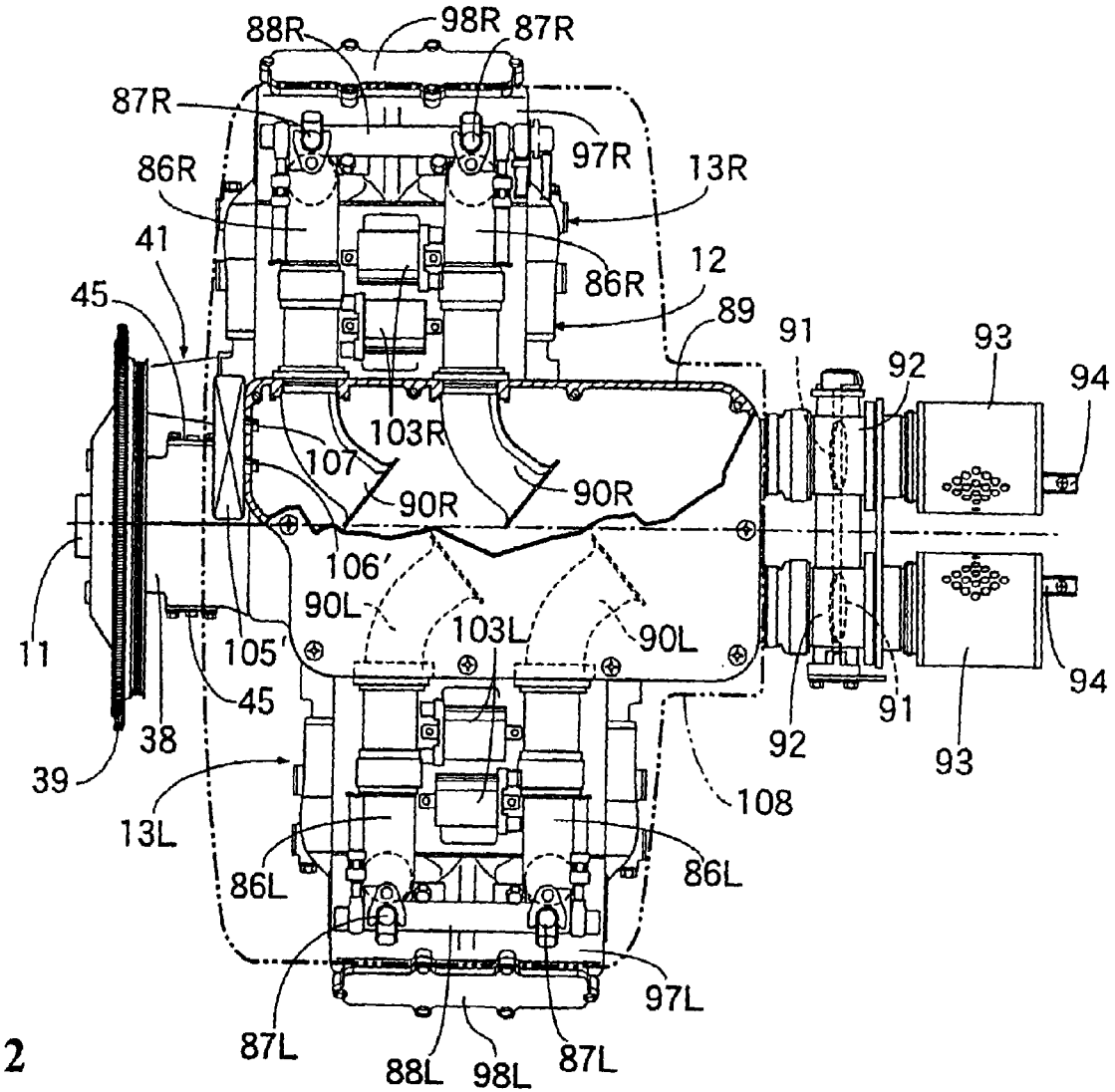
FIG. 2 is a plan view, partly cut away, of the engine.
Figure 3:
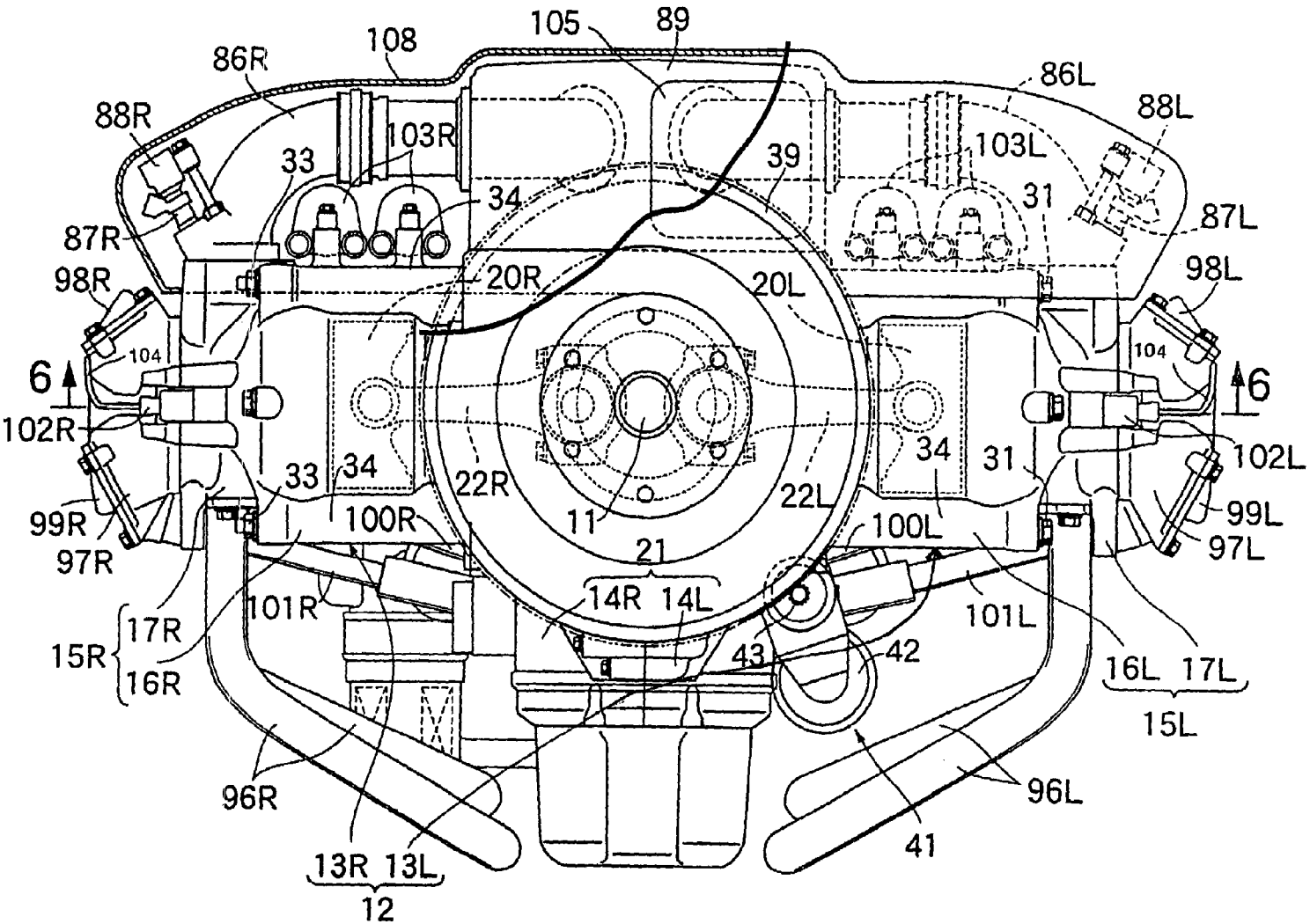
FIG. 3 is an enlarged front elevational view as viewed in the direction indicated by the arrow 3 in FIG. 1.

In FIGS. 1 through 3, the four-cycle horizontally opposite four-cylinder engine is mounted on an airplane, for example. The four-cycle horizontally opposite four-cylinder engine is housed in a front cowl of the airframe of the airplane with the axis of a crankshaft 11 extending longitudinally of the airplane, and a spinner having a plurality of propellers is coaxially coupled to the crankshaft 11.

Figure 4:
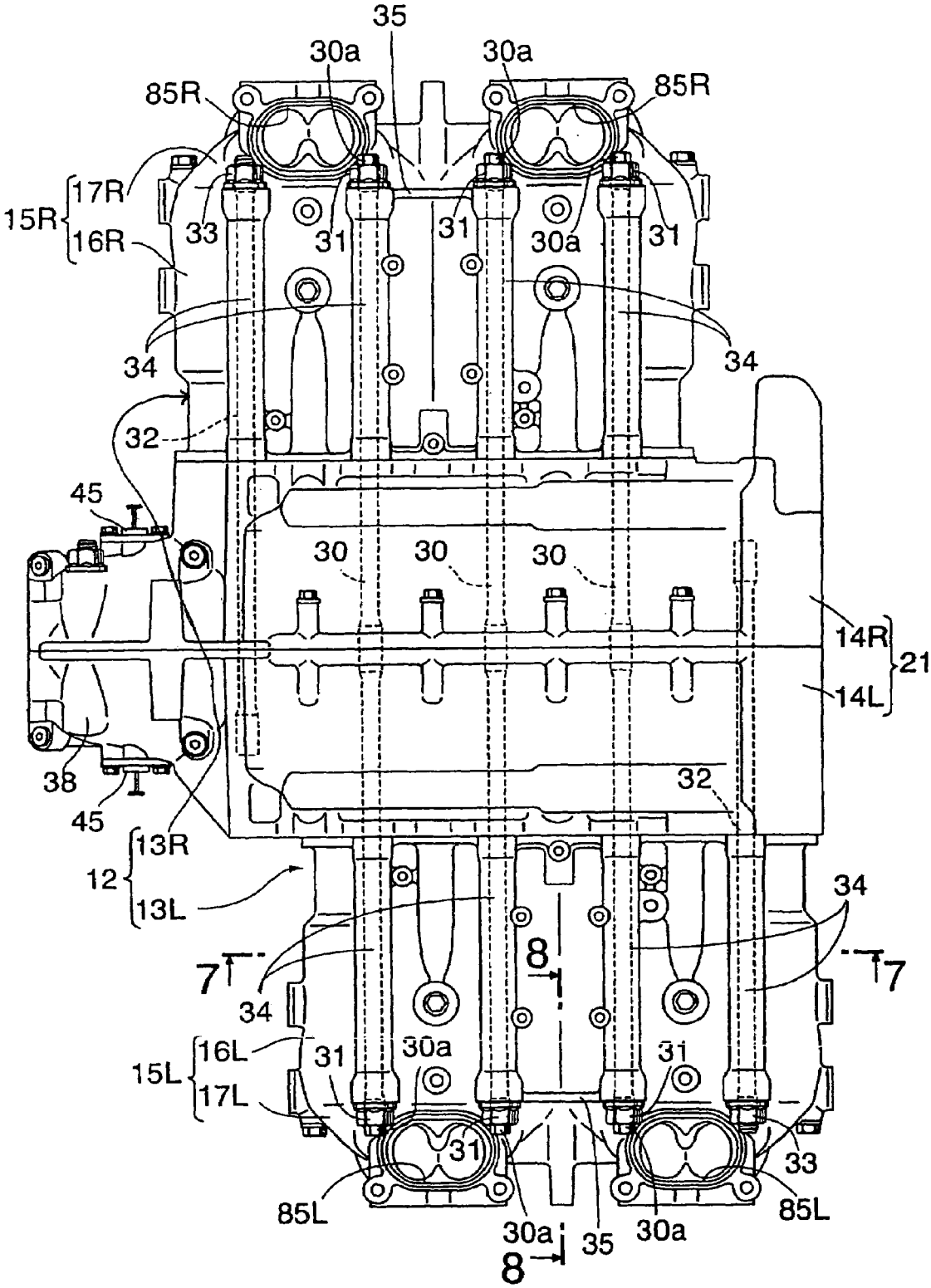
FIG. 4 is a plan view of an engine body.

As also shown in FIG. 4, the engine has an engine body 12 including a left engine block 13L disposed on the left side of the engine as viewed from behind and a right engine block 13R disposed on the right side of the engine as viewed from behind.

The left engine block 13L includes a left crankcase 14L and a left cylinder block 15L coupled to the left crankcase 14L. The right engine block 13R includes a right crankcase 14R coupled to the left crankcase 14L and a right cylinder block 15R coupled to the right crankcase 14R remotely from the left crankcase 14L.

The left cylinder block 15L includes a left cylinder barrel 16L coupled to the left crankcase 14L and a left cylinder head 17L integrally formed with the left cylinder barrel 16L remotely from the left crankcase 14L. The right cylinder block 15R includes a right cylinder barrel 16R coupled to the right crankcase 14R and a right cylinder head 17R integrally formed with the right cylinder barrel 16R remotely from the right crankcase 14R.

Figure 5:
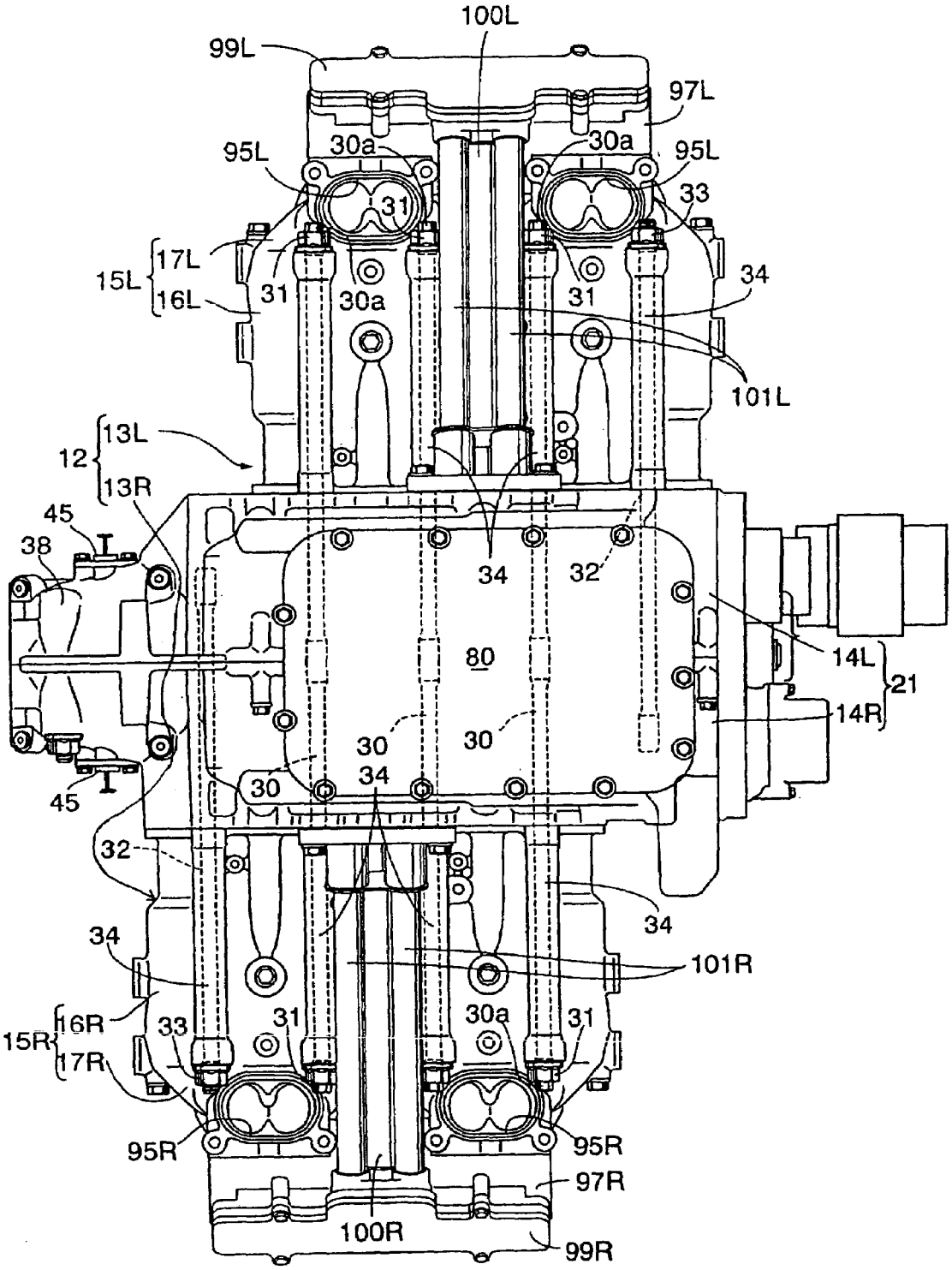
FIG. 5 is a bottom view of the engine body.
Figure 6:
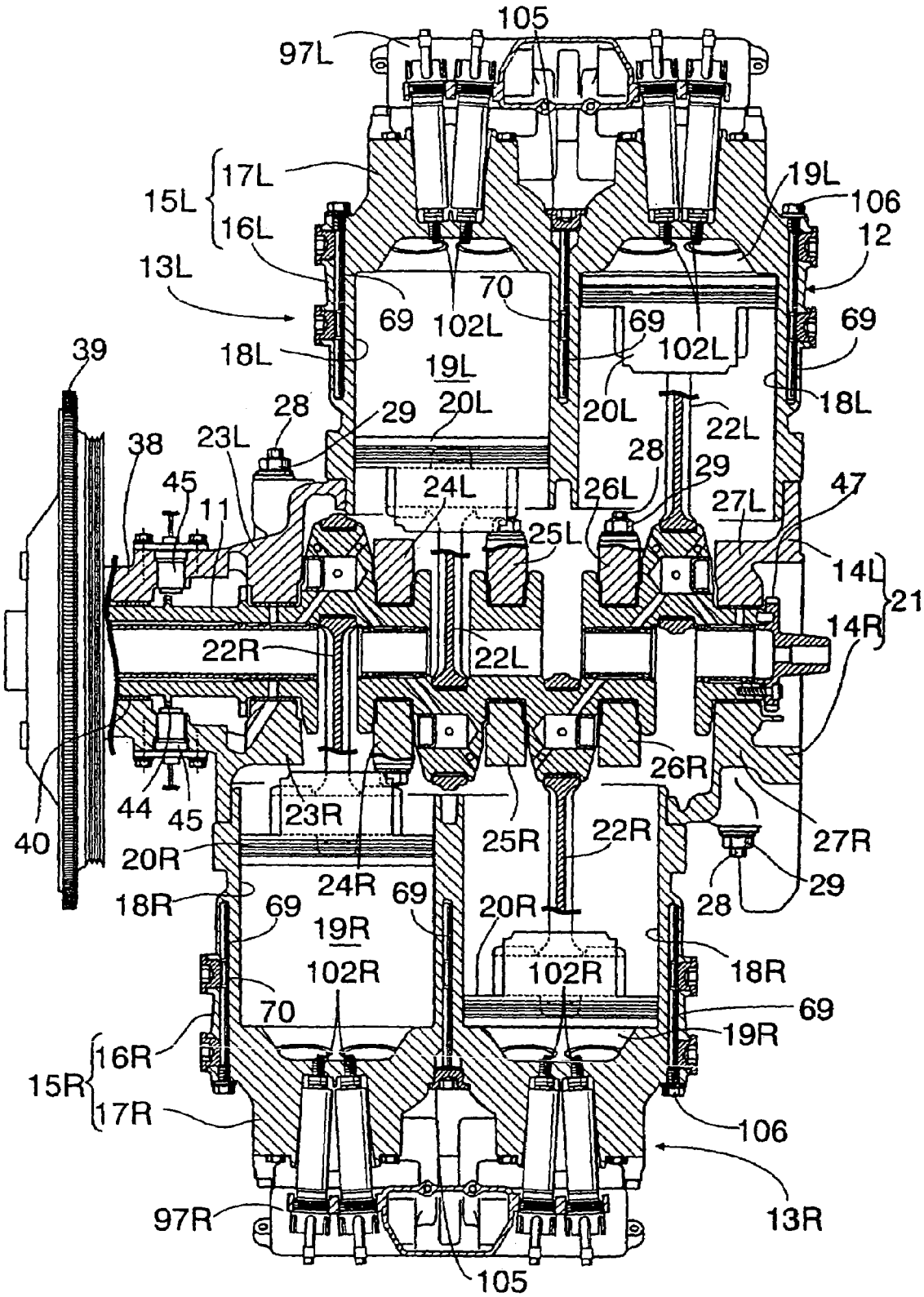
FIG. 6 is a cross-sectional view taken along line 6—6 of FIG. 3.

As also shown in FIGS. 5 and 6, the cylinder barrels 16L, 16R of the cylinder blocks 15L, 15R have respective pairs of cylinder bores 18L, 18L; 18R, 18R disposed on both sides of the crankshaft 11 and confronting each other. The cylinder bores 18L, 18L; 18R, 18R are arrayed in the axial direction of the crankshaft 11 and offset with respect to each other in the axial direction of the crankshaft 11. Pistons 20L . . . , 20R . . . , which define combustion chambers 19L . . . 19R . . . between the pistons and the cylinder heads 17L, 17R, are slidably fitted in the respective cylinder bores 18L . . . , 18R . . . .

The engine blocks 13L, 13R are arranged in opposed relation to each other with the axes of the cylinder bores 18L . . . , 18R . . . being disposed substantially horizontally. The left and right crankcases 14L, 14R are fastened to each other to jointly make up a crankcase 21. The crankshaft 11, connected to the pistons 20L . . . , 20R . . . by connecting rods 22L . . . , 22R . . . , is rotatably supported between the left and right crankcases 14L, 14R.

The left crankcase 14L has a front journal support wall 23L, a first intermediate journal support wall 24L, a second intermediate journal support wall 25L, a third intermediate journal support wall 26L and a rear journal support wall 27L. The walls support a left half of the crankshaft 11 on both the front and rear sides of the connecting rods 22L . . . and are longitudinally spaced from each other. The right crankcase 14R has a front journal support wall 23R, a first intermediate journal support wall 24R, a second intermediate journal support wall 25R, a third intermediate journal support wall 26R and a rear journal support wall 27R. The walls support a right half of the crankshaft 11 on both the front and rear sides of the connecting rods 22R . . . and are longitudinally spaced from each other. The crankshaft 11 is rotatably supported by the journal support walls 23L through 27L of the left crankcase 14L and the journal support walls 23R through 27R of the right crankcase 14R.

The journal support walls 23L through 27L and 23R through 27R of the left and right crankcases 14L, 14R are fastened by pairs of stud bolts 28 . . . and nuts 29 . . . which extend vertically across the crankshaft 11.

The stud bolts 28 . . . for fastening the front journal support walls 23L, 233R and the rear journal support walls 27L, 24R are longer than the stud bolts 28 . . . for fastening the first, second, and third intermediate journal support walls 24L through 26L; 24R through 26R.

The nuts 29 . . . engage an outer surface of the right crankcase 14R and are threaded over the stud bolts 28 . . . which are mounted on the front journal support wall 23L of the left crankcase 14L and inserted through the front journal support wall 23R of the right crankcase 14R. The nuts 29 . . . engage an outer surface of the left crankcase 14L and are threaded over the stud bolts 28 . . . which are mounted on the rear journal support wall 27R of the right crankcase 14R and inserted through the rear journal support wall 27L of the left crankcase 14L.

The nuts 29 . . . are threaded over the stud bolts 28 . . . that are mounted on the second and third intermediate journal support walls 25L, 26L of the left crankcase 14L and are inserted through the second and third intermediate journal support walls 25R, 26R of the right crankcase 14R. The nuts 29 . . . are held in engagement with the second and third intermediate journal support walls 25R, 26R. The nuts 29 . . . are threaded over the stud bolts 28 . . . that are mounted on the first intermediate journal support wall 24R of the right crankcase 14R and inserted through the first intermediate journal support wall 24L of the left crankcase 14L. The nuts 29 . . . are held in engagement with the first intermediate journal support walls 24L.

The left and right engine blocks 13L, 13R are coupled to each other by pairs of through bolts 30 . . . and pairs of two sets of stud bolts 32 . . . that are disposed in portions corresponding to the first, second, and third intermediate journal support walls 24L through 26L and 24R through 26R of the crankcases 14L, 14R.

The through bolts 30 . . . extend through the left and right engine blocks 13L, 13R in such a manner to sandwich, between themselves and the crankshaft 11, the pairs of stud bolts 28. The stud bolts 28 are disposed on the first, second, and third intermediate journal support walls 24L through 26L and 24R through 26R in order to fasten the support walls 24L through 26L and 24R through 26R to each other. Nuts 31 . . . are threaded over the opposite ends of the through bolts 30. . . , which project from the cylinder heads 17L, 17R of the left and right engine blocks 13L, 13R. In order to prevent the through bolts 30 . . . from rotating when the nuts 31 . . . are tightened, hexagonal tool engaging portions 30*a* for engagement with a tool (not shown) are coaxially disposed on the opposite ends of the respective through bolts 30 . . . so as to project from the nuts 31. . . .

Of the two sets of stud bolts 32 . . . , one set of stud bolts 32 . . . is mounted on the front journal support wall 23L of the left crankcase 13L and extends through the right engine block 13R and nuts 33 . . . are threaded over the stud bolts 32 . . . , which project from the cylinder head 17R of the right engine block 13R. Of the two sets of stud bolts 32 . . . , the other set of stud bolts 32 . . . is mounted on the rear journal support wall 27R of the right crankcase 13R and extends through the left engine block 13L, and nuts 33 . . . are threaded over the stud bolts 32 . . . which project from the cylinder head 17L of the left engine block 13L.

The stud bolts 32 . . . are disposed in positions for sandwiching, between themselves and the crankshaft 11, the pair of stud bolts 28 . . . fastening the front journal support walls 23L, 23R of the left and right crankcases 13L, 13R and the pair of stud bolts 28 . . . fastening the rear journal support walls 27L, 27R of the left and right crankcases 13L, 13R.

Figure 7:
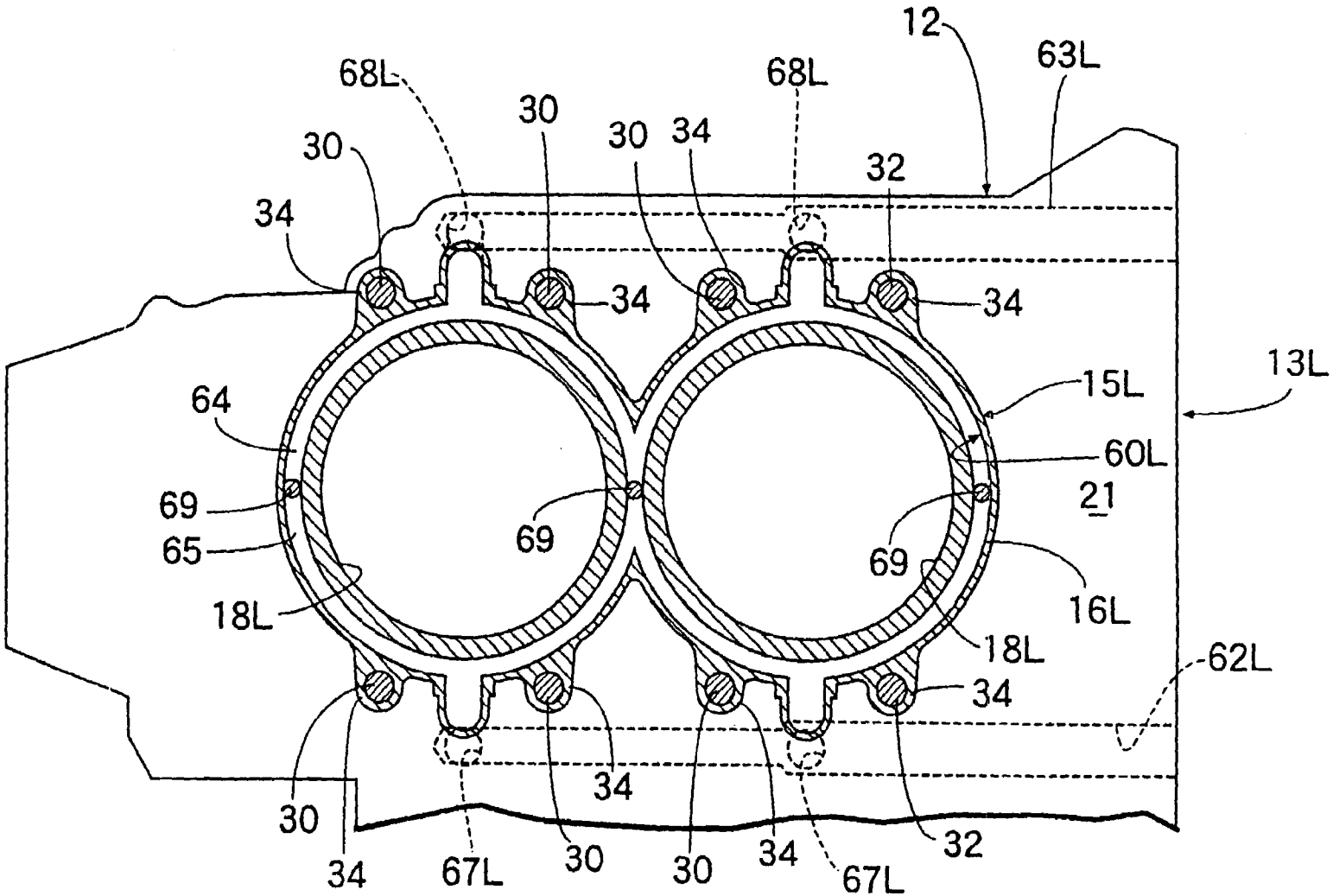
FIG. 7 is a cross-sectional view taken along line 7—7 of FIG. 4.

As shown in FIG. 7, the through bolts 30 . . . and the stud bolts 32 . . . are disposed in a surrounding relation to the cylinder bores 18L . . . , 18R . . . at 90°-spaced intervals. The cylinder blocks 13L, 13R have a plurality of integral mounting bosses 34 . . . for the through bolts 30 . . . and the stud bolts 32 . . . to extend therethrough. The mounting bosses 34 . . . extend from the surfaces of the cylinder barrels 16L, 16R, which are attached to the crankcase 21, to the cylinder heads 17L, 17R and surround the cylinder bores 18L . . . , 18R . . . .

Figure 8:
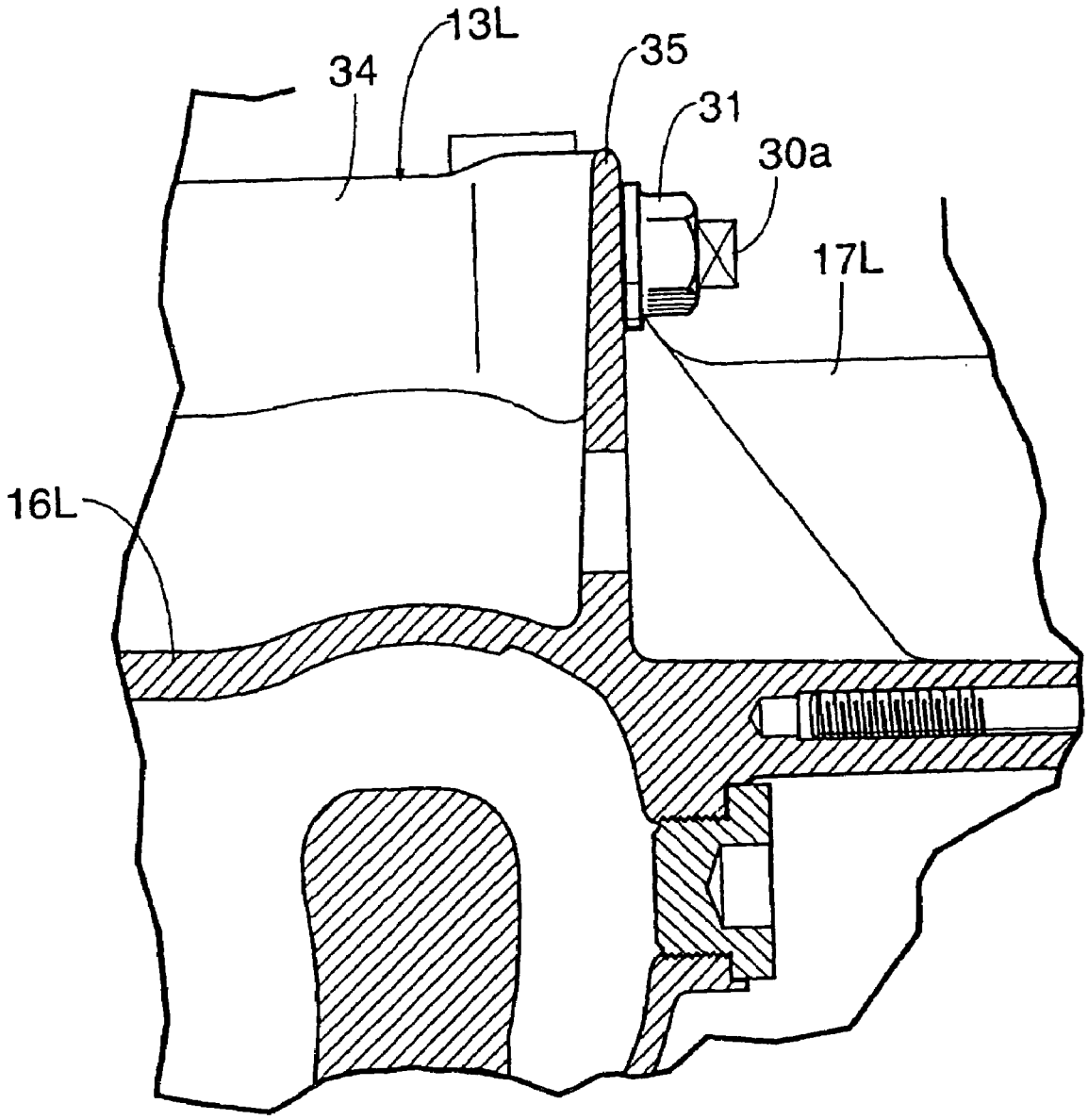
FIG. 8 is an enlarged cross-sectional view taken along line 8—8 of FIG. 4.

Joint walls 35 . . . are integrally mounted on the cylinder blocks 13L, 13R as shown in FIG. 8. The joint walls 35 . . . join at least one of the two adjacent sets of the mounting bosses 34, 34, which are disposed on corresponding portions between the mutually adjacent cylinder bores 18L, 18L; 18R, 18R arrayed in the axial direction of the crankshaft 11. The pair of mutually adjacent mounting bosses 34, 34 are on upper walls of the cylinder blocks 13L, 13R in the first embodiment.

A support tube 38, which is jointly made up of the left and right crankcases 14L, 14R, is formed so as to project forwardly on a front portion of the crankcase 21. The crankshaft 11 has a front portion extending coaxially through the support tube 38 and projecting from the front end of the support tube 38. A ring gear 39 is fixed to the portion of the crankshaft 11, which projects from the front end of the support tube 38. The spinner (not shown) is coaxially mounted on the ring gear 39. A slide bearing 40 is interposed between the front portion of the support tube 38 and the crankshaft 11, and an annular seal member (not shown) is interposed between the support tube 38 and the crankshaft 11 forwardly of the slide bearing 40.

For starting the engine, a starter 41 applies a rotational drive force to the crankshaft 11. The starter 41 includes a starter motor 42 and a pinion 43. The motor 42 is supported on a lower portion of the left crankcase 14 of the crankcase 21. The pinion 43 projects into mesh with the ring gear 39 when the rotational speed of the starter motor 42 becomes a predetermined value or higher. After the engine has started to operate, the pinion 43 is released out of mesh with the ring gear 39 back into its original position.

The crankshaft 11 has a plurality of circumferentially spaced teeth 44 within the support tube 38. A pair of crankshaft angle sensors 45, 45, for detecting a crankshaft angle, is mounted on the support tube 38 by the projections 44 . . . in 180°-spaced relation to each other.

Figure 9:
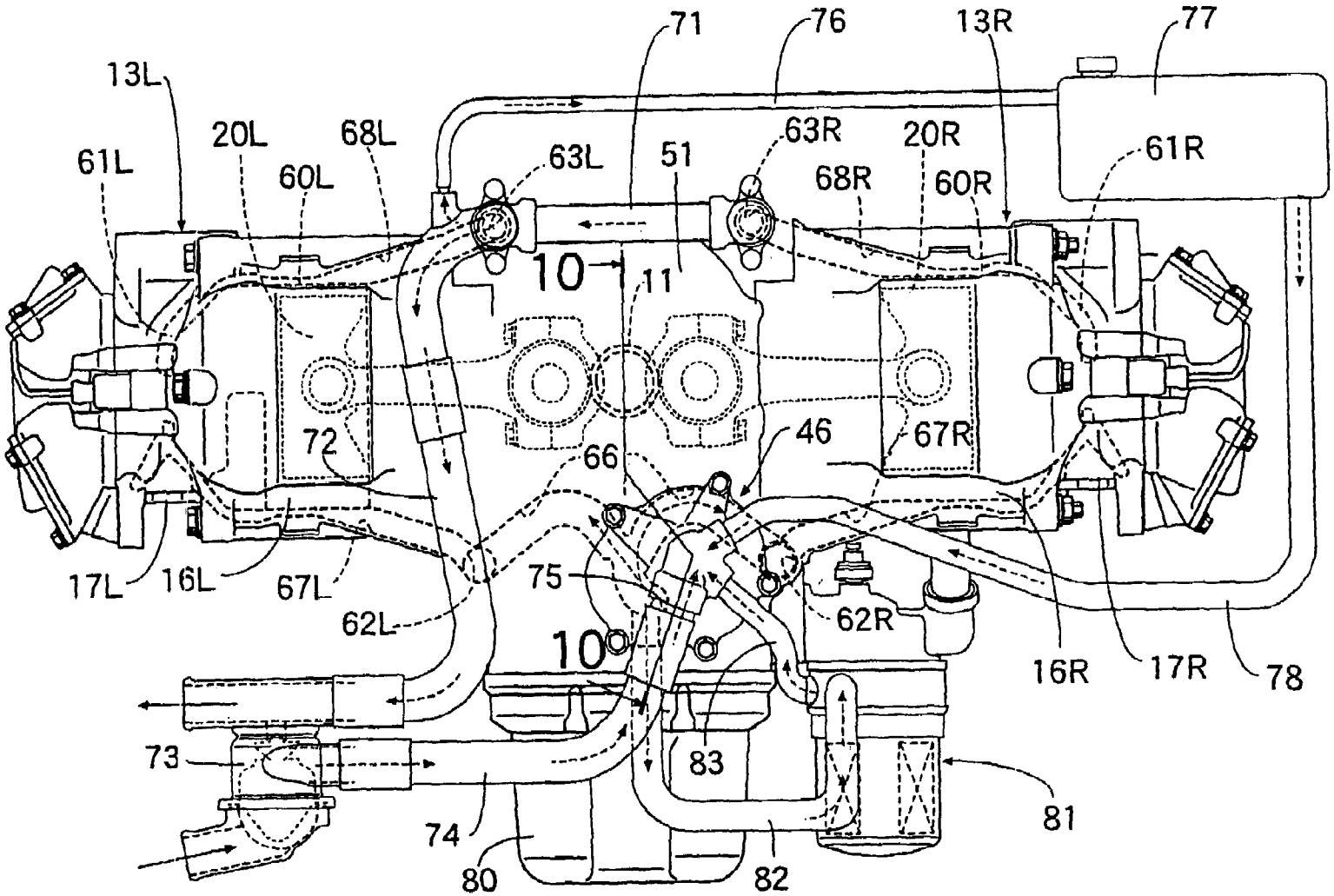
FIG. 9 is a rear view of the engine, showing a coolant circulating system.
Figure 10:
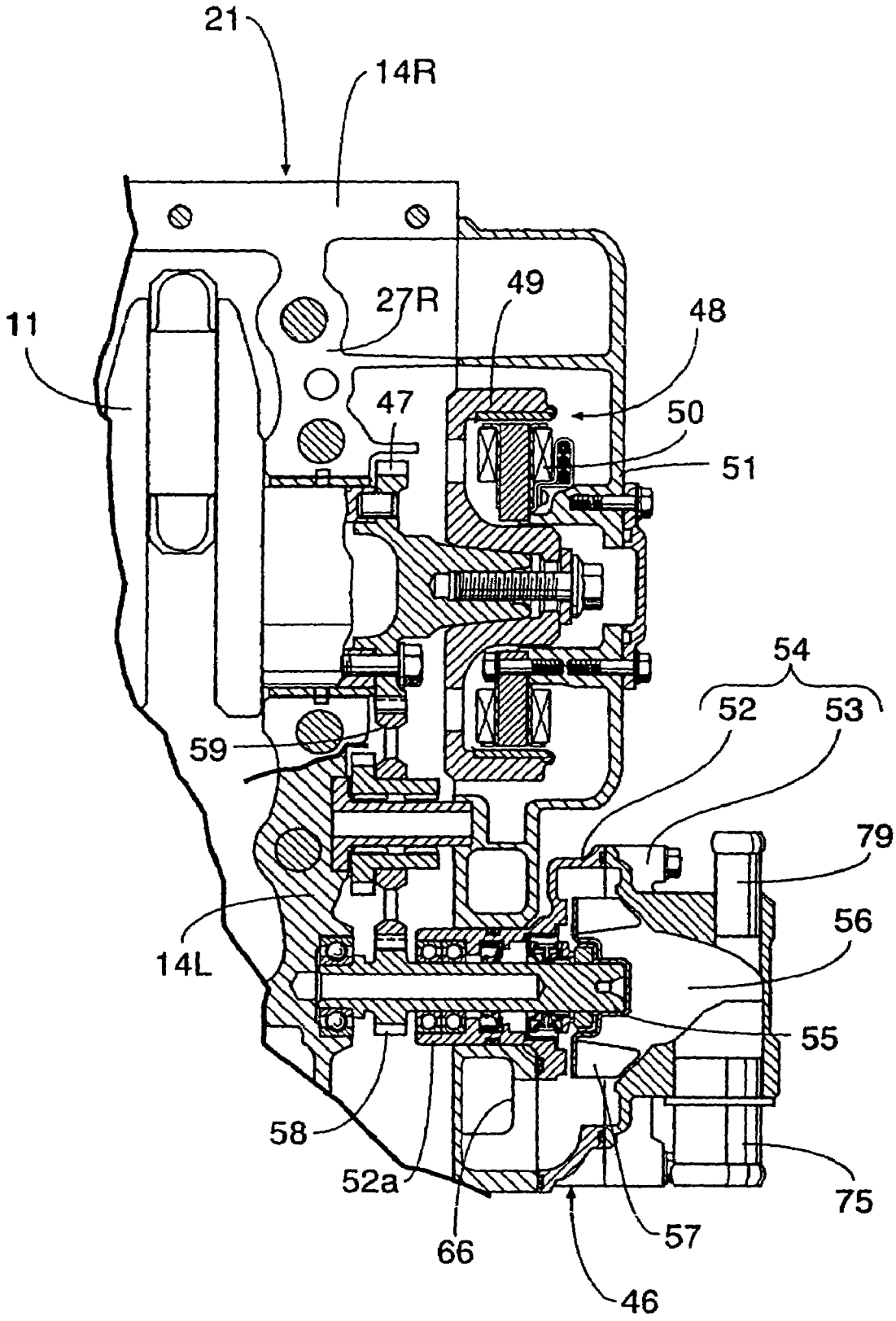
FIG. 10 is a cross-sectional view taken along line 10—10 of FIG. 9.

As also shown in FIGS. 9 and 10, a water pump 46, which can be rotated by the crankshaft 11, is mounted on an end of the crankcase 21 along the axis of the crankshaft 11, i.e., a rear end of the crankcase 21 in the first embodiment.

A drive gear 47 is coaxially mounted on a rear end of the crankshaft 11, which projects from the rear journal support walls 27L, 27R. A rotor 49 of a generator 48, which is mounted in a rear portion of the crankcase 21, is coaxially and relatively immovably connected to the drive gear 47. A cover 51 is mounted on the rear end of the crankcase 21. The generator 48 has a stator 50 mounted on the cover 51.

The water pump 46 has a pump housing 54 including a case 52, which integrally has a cylindrical shaft support 52*a* that is fitted in the cover 51 in a light-tight manner and a pump cover 53 sandwiching the case 52 between itself and the cover 51. The case 52 and the pump cover 53 are fastened together to the cover 51.

A pump shaft 55, which extends through the shaft support 52*a* in a light-tight manner, is rotatably supported by the shaft support 52*a*. An end of the pump shaft 55, which projects from the shaft support 52*a*, is rotatably supported by the crankcase 21. Rotary vanes 57 are fixed to the other end of the pump shaft 55 within a pump chamber 56 that is defined in the pump housing 54. A driven gear 58, which is fixed to the pump shaft 55 between the shaft support 52*a* and the crankcase 21, is held in mesh with an idle gear 59 that is rotatably supported between the crankcase 21 and the cover 51. The idle gear 59 is in mesh with the drive gear 47.

Cooling cylinder water jackets 60L, 60R are disposed in the respective cylinder barrels 16L, 16R. Head water jackets 61L, 61R communicating respectively with the cylinder water jackets 60L, 60R are disposed in the respective cylinder heads 17L, 17R, which are integrally formed with the cylinder barrels 16L, 16R. The water pump 46 serves to circulate a coolant between the cylinder and head water jackets 60L, 60R; 61L, 61R. The crankcase 21 has coolant supply passages 62L, 62R for guiding the coolant from the water pump 46 and coolant return passages 63L, 63R for guiding the coolant that is delivered out of the cylinder water jackets 60L, 60R. The coolant supply passages 62L, 62R and the coolant return passages 63L, 63R are disposed parallel to the axis of the crankshaft 11 on both sides of the axes of the cylinder bores 18L . . . , 18R . . . .

The cylinder and head water jackets 60L, 60R; 61L, 61R are formed such that the coolant supplied from the coolant supply passages 62L, 62R returns from the cylinder water jackets 60L, 60R via the head water jackets 61L, 61R to the cylinder water jackets 60L, 60R. The cylinder water jackets 60L, 60R are divided into supply jacket portions 64 . . . and return jacket portions 65. The supply jacket portions 64 . . . communicate with the coolant supply passages 62L, 62R and also with the head water jackets 61L, 61R. The return jacket portions 65 . . . communicate with the head water jackets 61L, 61R at positions spaced from the supply jacket portions 64 . . . and are defined in the cylinder barrels 16L, 16R.

The cover 51 joined to the crankcase 21 has a passage 66 for guiding the coolant discharged from the pump chamber 56 of the water pump 46 to the coolant supply passages 62L, 62R.

The supply jacket portions 64 and the return jacket portions 65. . . , with superposed portions surrounding substantial half of the cylinder bores 18L 18R . . . , are formed in the cylinder barrels 16L, 16R. A plurality of supply and return branch passages 67L, 67R; 68L, 68R are disposed in the crankcase 21 and the cylinder barrels 16L, 16R. The supply and return branch passages 67L, 67R; 68L, 68R are connect the portions of the supply jacket portions 64 . . . and the return jacket portions 65 . . . , which correspond to the cylinder bores 18L . . . , 18R . . . , to the coolant supply passages 62L, 62R and the coolant return passages 63L, 63R.

The coolant supply passages 62L, 62R are reduced in diameter stepwise in a direction away from the water pump 46. The inside diameter of the supply passages 62L, 62R in the cylinder bores 18L, 18R that is most remote from the water pump 46 is smaller than the inside diameter thereof in the cylinder bores 18L, 18R closer to the water pump 46.

When the cylinder blocks 13L, 13R are cast, the cylinder water jackets 60L, 60R are formed within the cylinder barrels 16L, 16R as ring-shaped cavities surrounding the respective cylinder bores 18L . . . , 18R . . . . Rod members 69 . . . are fitted into the cylinder barrels 16L, 16R from the cylinder heads 17L, 17R so as to lie on a straight line interconnecting the axes of the cylinder bores 18L . . . , 18R . . . . The rod members 69 . . . divide the cavities halfway into the supply jacket portions 64 . . . and the return jacket portions 65 . . . .

The rod members 69 . . . have intermediate portions smaller in diameter for forming an annular passage 70 for removing air from the supply jacket portions 64 . . . into the return jacket portions 65 . . . , between themselves and the cylinder barrels 16L, 16R.

Plug members 105 . . . , 106 . . . , for preventing the rod members 69 . . . from being released from the cylinder heads 17L, 17R, are threaded in the cylinder heads 17L, 17R in abutment against the rod members 69. . . .

Referring to FIG. 9 in particular, the coolant return passages 63L, 63R communicate with each other through a joint pipe 71. A first return conduit 72 communicates with the coolant return passage 63L and is connected to the crankcase 21 for guiding the coolant to a radiator (not shown). The coolant, which returns from the radiator, is guided to a second return conduit 74. A thermostat 73 for guiding the coolant from the first return conduit 72 to the second return conduit 74 by bypassing the radiator when the temperature of the coolant is low is disposed between the first and second return conduits 72, 74. The second return conduit 74 is connected to a return joint pipe 75 that is joined to the pump cover 53 of the water pump 46.

A steam conduit 76, for guiding a steam evaporated by heating into an expansion tank 77, is connected to an upper portion of the first return conduit 72. A third return pipe 78 for guiding the coolant that is condensed in the expansion tank 77 is connected to a return joint pipe 79 that is joined to the pump cover 53 of the water pump 46. An oil filter 81 is disposed laterally of an oil pan 80 mounted on a lower portion of the crankcase 21. The oil filter 81 houses therein an oil cooler that is supplied with the coolant from the water pump 46 via a supply conduit 82. The coolant from the oil cooler is returned to the water pump 46 via a return conduit 83.

Intake ports 85L . . . , 85R . . . corresponding individually to the combustion chambers 19L . . . , 19R . . . are defined in upper portions of the left and right cylinder heads 17L, 17R. The intake ports 85L . . . , 85R . . . are bifurcated and communicate with the combustion chambers 19L . . . , 19R . . . .

Arcuately curved intake pipes 86L . . . , 86R . . . are connected respectively to the intake ports 85L . . . , 85R . . . . Electromagnetic fuel injector valves 87L . . . , 87R . . . for injecting a fuel into the intake ports 85L . . . , 85R . . . are mounted respectively in intermediate portions of the intake pipes 86L . . . , 86R . . . The electromagnetic fuel injector valves 87L . . . in the left engine block 13L are connected to a common fuel rail 88L, and the electromagnetic fuel injector valves 87R . . . in the right engine block 13R are connected to a common fuel rail 88R.

An intake chamber 89 is disposed above the crankcase 21 of the engine body 12 and supported by the engine body 12. The intake pipes 86L . . . 86R . . . have upstream ends connected to downstream ends of joint pipes 90L . . . , 90R . . . , which have upstream ends projecting into the intake chamber 89 from both sides thereof. In the intake chamber 89, the upstream ends of the joint pipes 90L . . . , 90R . . . are spread into a flaring shape and open rearwardly.

Throttle bodies 92, 92 each having a throttle valve 91 angularly movably supported therein with downstream ends juxtaposed and connected to a rear portion of the intake chamber 89. Air cleaners 93, 93 are connected respectively to upstream ends of the throttle bodies 92, 92. The air cleaners 93, 93 are supported on support stays 94, 94, which are mounted on the intake chamber 89 and extend rearwardly.

Exhaust ports 95L . . . , 95R . . . , which correspond individually to the combustion chambers 19L . . . , 19R . . . are defined in lower portions of the left and right cylinder heads 17L, 17R. Exhaust pipes 96L . . . 96R . . . extending below the engine body 12 and rearwardly are connected respectively to the exhaust ports 95L . . . , 95R . . . .

Substantially H-shaped head covers 97L, 97R are joined respectively to the left and right cylinder heads 17L, 17R. Valve operating devices (not shown) for actuating intake valves and exhaust valves to control the introduction of intake air into the combustion chambers 19L . . . , 19R . . . and the discharge of exhaust gases from the combustion chambers 19L . . . , 19R . . . are disposed between the head covers 97L, 97R and the cylinder heads 17L, 17R. Covers 98L, 98R are fastened to upper portions of the head covers 97L . . . . The covers 98L, 98R cover intake valve operating portions of the valve operating devices. Covers 99L, 99R, which cover exhaust valve operating portions of the valve operating devices, are fastened to lower portions of the head covers 97L . . . .

The intake valve operating portions of the valve operating devices, which are disposed between the head covers 97L, 97R and the cylinder heads 17L, 17R, produce valve opening drive forces with push rods that are pushed upwardly in the intake stroke by the power transmitted from the drive gear 47 of the crankshaft 11. The push rods associated with the respective combustion chambers 19L . . . , 19R . . . are axially movably inserted in rod guide tubes 100L, 100R. The tubes 100L, 100R are disposed below the cylinder blocks 15L, 15R on the left and right sides of the crankcase 21 and interconnecting longitudinally central portions of the lower portions of the left and right crankcases 14L, 14R and the head covers 97L, 97R.

The exhaust valve operating portions of the valve operating devices, which are disposed between the head covers 97L, 97R and the cylinder heads 17L, 17R, produce valve opening drive forces with pull rods that are pulled downwardly in the exhaust stroke by the power transmitted from the drive gear 47 of the crankshaft 11. The pull rods associated with the respective combustion chambers 19L . . . , 19R . . . are axially movably inserted in rod guide tubes 101L, 101R. The tubes 101L, 101R are disposed below the rod guide tubes 100L, 100R and for interconnecting the longitudinally central portions of the lower portions of the left and right crankcases 14L, 14R and the head covers 97L, 97R.

Thus, the rod guide tubes 100L, 100R, 101L . . . , 101R . . . are disposed to interconnect the longitudinally central portions of the lower portions of the left and right crankcases 14L, 14R and the head covers 97L, 97R. The pair of mutually adjacent mounting bosses 34, 34 on the upper wall of the cylinder blocks 13L, 13R are connected by the joint walls 35 . . . and are integral with the cylinder blocks 13L, 13R. The rod guide tubes 100L, 100R, 101L . . . , 101R . . . and the joint walls 35 are disposed on upper and lower sides of the cylinder blocks 13L, 13R.

Pairs of ignition plugs 102L, 102L . . . , 102R, 102R . . . , which are associated with the respective combustion chambers 19L . . . , 19R . . . , are mounted in the cylinder heads 17L, 17R. Ignition coils 103L . . . , 103R . . . as electric accessories are mounted on upper side surfaces of the cylinder heads 17L, 17R between the intake pipes 86L, 86L; 86R, 86R. The ignition coils 103L . . . , 103R . . . are disposed by a pair on each side of the intake chamber 89. Pairs of high-tension cords 104 connected to the ignition coils 103L . . . , 103R . . . are connected to the ignition plugs 102L, 102L . . . , 102R, 102R . . . .

To allow the fuel to be reliably ignited in the combustion chambers 19L . . . , 19R . . . even in the event that one of the ignition coils 103L . . . , 103R . . . malfunctions, a pair of high-tension cords 104, 104 connected to the same ignition coils 103L . . . , 103R . . . is connected to the ignition plugs 102L . . . , 102R . . . of the different combustion chambers 19L . . . , 19R . . . .

An electronic control unit 105' for controlling the operation of the engine is mounted on the outer surface of a front side wall of the intake chamber 89. An intake pressure sensor 106' and an intake temperature sensor 107 are inserted from the electronic control unit 105' into the intake chamber 89 through the front side wall of the intake chamber 89. The intake pressure sensor 106' and an intake temperature sensor 107 is for detecting the intake pressure and temperature, respectively, in the intake chamber 89.

The electromagnetic fuel injector valves 87L . . . , 87R . . . , the ignition coils 103L . . . , 103R . . . , and the electronic control unit 105' are disposed around the intake chamber 89. The electromagnetic fuel injector valves 87L . . . , 87R . . . , the ignition coils 103L . . . , 103R . . . , and the electronic control unit 105' are covered with a shield cover 108, which is mounted on the engine body 12 in a covering relationship to at least a portion of the intake chamber 89.

In the first embodiment, the shield cover 108 is made of a steel sheet, for example, in a covering relationship to a substantial portion of the intake chamber 89 except a rear portion thereof and an upper portion of the engine body 12. The shield cover 108 has an opening edge formed in contact with the engine body 12. Portions of the high-tension cords 104 extending from the ignition coils 103L . . . , 103R . . . are also covered with the shield cover 108.

Since the electromagnetic fuel injector valves 87L . . . , 87R . . . , the ignition coils 103L . . . , 103R . . . , and the electronic control unit 105' are covered with the single shield cover 108, the electric accessories can be shielded. The number of parts used is reduced and the overall engine is made more compact than if the electric accessories are individually shielded. As the portions of the high-tension cords 104 . . . are covered with the shield cover 108, those portions of the shield cover 108 may have their individual shields removed. Therefore, a secondary voltage drop across the high-tension cords 104 . . . may be improved by removing the individual shields.

Thus, the electronic control unit 105' is mounted on the outer surface of the front side wall of the intake chamber 89. Further, the intake pressure sensor 106' and the intake temperature sensor 107 for detecting the intake pressure and temperature, respectively, in the intake chamber 89 are inserted from the electronic control unit 105' into the intake chamber 89 through the front side wall of the intake chamber 89. The electronic control unit 105' can be shielded, and also the intake pressure sensor 106' and the intake temperature sensor 107 can be directly connected to the electronic control unit 105'. As a result, the labor of connecting lead wires can be eliminated.

The operation of the first embodiment will be described below. The water pump 46 is mounted on an end of the crankcase 21 along the axis of the crankshaft 11. The coolant supply passages 62L, 62R guide the coolant from the water pump 46, and the coolant return passages 63L, 63R guide the coolant that is delivered out of the cylinder water jackets 60L, 60R of the cylinder barrels 16L, 16R. The supply passages 62L, 62R and the return passages 63L, 63R are formed parallel to the axis of the crankshaft 11 on both sides of the axes of the cylinder bores 18L . . . , 18R . . . . The cylinder water jackets 60L, 60R and the head water jackets 61L, 61R are formed such that the coolant supplied from the supply passages 62L, 62R returns from the cylinder water jackets 60L, 60R via the head water jackets 61L, 61R to the cylinder water jackets 60L, 60R.

Therefore, no piping is required outside of the engine for guiding the coolant from the water pump 46 to the cylinder barrels 16L, 16R, and no piping is required outside of the engine for delivering out the coolant from the cylinder heads 17L, 17R. Therefore, the coolant piping around the engine is simplified.

The cylinder water jackets 60L, 60R are divided into supply jacket portions 64 . . . and return jacket portions 65 . . . and are defined in the cylinder barrels 16L, 16R. The supply jacket portions 64 . . . communicate with the coolant supply passages 62L, 62R and also with the head water jackets 61L, 61R. The return jacket portions 65 . . . communicate with the coolant return passages 63L, 63R and also with the head water jackets 61L, 61R at positions spaced from the supply jacket portions 64 . . . . Consequently, the coolant supply passages 62L, 62R and the coolant return passages 63L, 63R can be cast or drilled in one direction along the axis of the crankshaft 11. Therefore, the machinability for forming the passages is increased.

The supply jacket portions 64 and the return jacket portions 65 . . . , with superposed portions surrounding substantial half of the cylinder bores 18L . . . , 18R . . . , are formed in the cylinder barrels 16L, 16R, which have the cylinder bores 18L . . . , 18R . . . arrayed in the axial direction of the crankshaft 11. A plurality of supply and return branch passages 67L, 67R . . . ; 68L, 68R . . . are disposed between the crankcase 21 and the cylinder barrels 16L, 16R. The plurality of supply and return branch passages 67L, 67R . . . ; 68L, 68R . . . connect the portions of the supply jacket portions 64 . . . and the return jacket portions 65 . . . , which correspond to the cylinder bores 18L . . . , 18R . . . , to the coolant supply passages 62L, 62R and the coolant return passages 63L, 63R. Thus, a passage structure for uniformly cooling portions corresponding to the respective cylinder bores 18L . . . , 18R . . . in a multicylinder engine can easily be constructed.

By changing stepwise the diameters of the coolant supply passages 62L, 62R and the coolant return passages 63L, 63R, which extend linearly, the amount of the coolant flowing through the cylinder water jackets 60L, 60R and the head water jackets 61L, 61R, which correspond to the cylinder bores 18L . . . , 18R . . . , can be made more uniform.

Since the cylinder barrels 16L, 16R and the cylinder heads 17L, 17R are integrally formed by mutually joining the cylinder water jackets 60L, 60R and the head water jackets 61L, 61R, a sand core in the shape of a succession of the cylinder and head water jackets 60L, 60R; 61L, 61R is integrally formed for increased productivity for the cylinder barrels 16L, 16R and the cylinder heads 17L, 17R.

The rod members 69 . . . divide the ring-shaped cavities, which is defined in the cylinder barrels 16L, 16R in surrounding relation to the cylinder bores 18L . . . , 18R . . . in a casting process, halfway into the supply and return jacket portions 64 . . . , 65 . . . . The rod members 69 are fitted into the cylinder barrels 16L, 16R from the cylinder heads 17L, 17R. Therefore, the portion of the sand core, which corresponds to the cylinder bores 18L . . . , 18R . . . of the cylinder water jackets 60L, 60R, may be ring-shaped for easy sand removal to increase productivity and castability. In addition, the cylinder water jackets 60L, 60R can easily be divided into the supply jacket portions 64 . . . and the return jacket portions 65 . . . .

The cylinder blocks 13L, 13R, which have the cylinder barrels 16L, 16R and the cylinder heads 17L, 17R integrally formed to provide communication between the cylinder water jackets 60L, 60R and the head water jackets 61L, 61R have a plurality of mounting bosses 34 . . . . The bosses 34 . . . extend from the surfaces of the cylinder barrels 16L, 16R, which are attached to the crankcase 21, to the cylinder heads 17L, 17R. The bosses 34 . . . . surround the cylinder bores 18L . . . , 18R . . . in the cylinder heads 17L, 17R. The cylinder blocks 13L, 13R are fastened to the crankcase 21 by the through bolts 30 . . . and the stud bolts 30 . . . extending through the mounting bosses 34 . . . . Therefore, the cylinder barrels 16L, 16R and the cylinder heads 17L, 17R can simply be joined to the crankcase 21. A gasket is not required between the cylinder barrels 16L, 16R and the cylinder heads 17L, 17R, bolts, which would otherwise be needed to keep the sealing ability of gaskets. As a result, the number of parts used is reduced, and the weight of the engine can be reduced. Furthermore, the surrounding areas of the cylinder bores 18L . . . , 18R . . . can sufficiently be stiffened by the mounting bosses 34 . . . surrounding the cylinder bores 18L . . . , 18R . . . . The surrounding areas can withstand the tightening loads on the through bolts 30 . . . and the stud bolts 32 . . . that are inserted through the mounting bosses 34 . . . .

The joint walls 35 . . . are integrally mounted on the cylinder blocks 13L, 13R. The joint walls 35 . . . join at least one of the two adjacent sets of the mounting bosses 34, 34, which are disposed on corresponding portions between the mutually adjacent cylinder bores 18L, 18L; 18R, 18R arrayed in the axial direction of the crankshaft 11. The joint walls 35 . . . join the pair of mutually adjacent mounting bosses 34, 34 on the upper walls of the cylinder blocks 13L, 13R in the first embodiment. Therefore, no bolts need to be disposed between the cylinder bores 18L . . . , 18R . . . , and the mechanical strength of the cylinder barrels 16L, 16R between the cylinder bores 18L . . . , 18R . . . can be increased by the joint walls 35 . . . . The distance between the cylinder bores 18L . . . , 18R . . . in the direction along the axis of the crankshaft 11 can be shortened for making the engine smaller in size.

The rod guide tubes 100L, 100R, 101L . . . , 101R . . . axially movably insert the push rods and the pull rods of the valve operating device for transmitting the power of the crankshaft 11. The rod guide tubes 100L, 100R, 101L . . . , 101R . . . and the joint walls 35 are disposed on the upper and lower sides of the cylinder blocks 13L, 13R. Therefore, the rigidity of the cylinder blocks 13L, 13R is of an improved balance, preventing the inside diameter of the cylinder bores 18L . . . , 18R . . . in the cylinder blocks 13L, 13R from varying.

Figure 11:
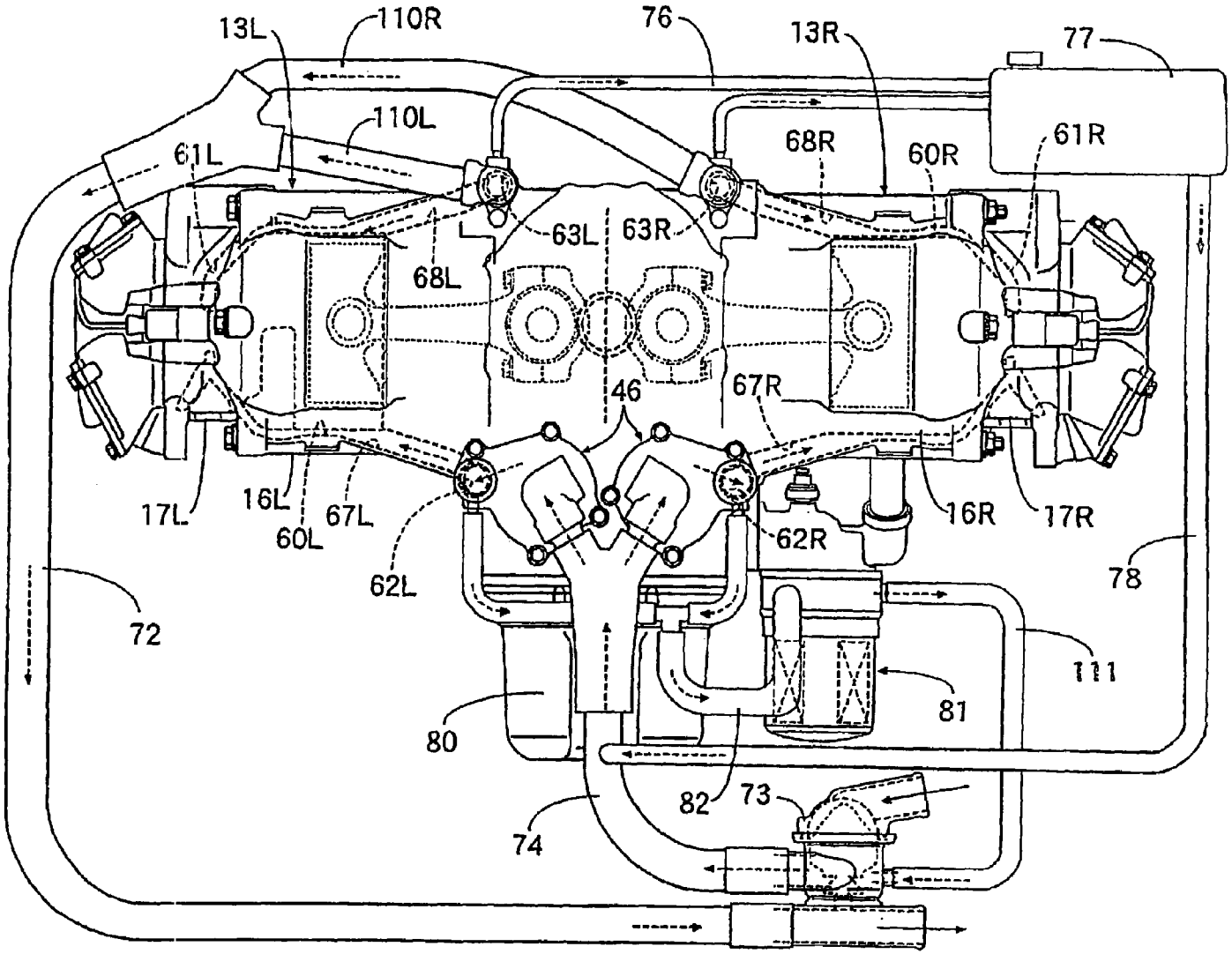
FIG. 11 is a view corresponding to FIG. 9, showing a second embodiment.

FIG. 11 shows a second embodiment of the present invention. The parts of the second embodiment corresponding to those of the first embodiment are denoted by identical reference characters.

A pair of water pumps 46 rotatable by the crankshaft 11 is mounted on the crankcase 21 on one end of the crankshaft 11, i.e., a rear end of the crankshaft 11 in the second embodiment.

The crankcase 21 has a coolant supply passage 62L, a coolant supply passage 62R, a coolant return passage 63L and a coolant return passage 63R. The coolant supply passage 62L guides the coolant from one of the water pumps 46 into the supply jacket portion 64 in the cylinder water jacket 60L in the left cylinder barrel 16L. The coolant supply passage 62R guides the coolant from the other of the water pumps 46 into the supply jacket portion 64 in the cylinder water jacket 60R in the right cylinder barrel 16R. The coolant return passage 63L guides the coolant that is delivered out of the return jacket portion 65 in the cylinder water jacket 60L in the left cylinder barrel 16L. The coolant return passage 63R guides the coolant that is delivered out of the return jacket portion 65 in the cylinder water jacket 60R in the right cylinder barrel 16R. These passages are defined parallel to the axis of the crankshaft 11 on both sides of the cylinder bores 18L, 18R as viewed in a figure projecting onto a plane perpendicular to the axes of the cylinder bores 18L, 18R.

Individual return conduits 110L, 110R are individually connected to the coolant return passages 63L, 63R. The return conduits 110L, 110R are connected in common to the first return conduit 72. The coolant returning from the non-illustrated radiator is guided into the second return conduit 74, which is connected in common to the water pumps 46. A thermostat 73 is disposed between the first and second return conduits 72, 74. The thermostat 73 guides the coolant from the first return conduit 72 to the second return conduit 74 by bypassing the radiator when the temperature of the coolant is low.

A steam conduit 76 for guiding steam evaporated by heating into an expansion tank 77 is connected to an upper portion of the cylinder block 13L in communication with the coolant return passage 63L. A third return pipe 76 for guiding the coolant that is condensed in the expansion tank 77 is connected to the second return conduit 74. An oil cooler disposed in an oil filter 81 is supplied with the coolant from the water pumps 46, 46 via the supply conduit 82, and the coolant from the oil cooler is returned to the thermostat 73 via a return conduit 111.

The second embodiment offers the same advantages as those of the first embodiment.

While the embodiments of the present invention have been described above, the present invention is not limited to the above embodiments, but various design changes may be made without departing from the invention as defined in the scope of claims for patent.

For example, the present invention has been described as being applied to a horizontally opposed multicylinder engine in the first and second embodiments described above. However, the present invention is also applicable to a V-shaped multicylinder engine or a single-cylinder engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine cooling structure in which cylinder barrels having cylinder bores and cooling cylinder water jackets are coupled to a crankcase with a crankshaft rotatably supported therein, cylinder heads having head water jackets communicating with the cylinder water jackets are coupled to the cylinder barrels with combustion chambers defined between the cylinder heads and the cylinder barrels, pistons slidably fitted in the cylinder bores have top ends facing the combustion chambers, and a water pump for circulating a coolant between the cylinder and head water jackets is mounted on the crankcase on one end thereof along the axis of the crankshaft comprising:

coolant supply passages formed in said crankcase for guiding the coolant from said water pump;

coolant return passages formed in said crankcase for guiding the coolant led from the cylinder water jackets;

said coolant supply passages and the coolant return passages extending substantially parallel to the axis of said crankshaft with the axes of said cylinder bores being disposed therebetween and said cylinder water jackets and said head water jackets are formed such that the coolant supplied from said coolant supply passages returns from said cylinder water jackets through said head water jackets to said cylinder water jackets, wherein said cylinder water jackets are formed in said cylinder barrels for being divided into a supply jacket portion communicating with said coolant supply passages and communicating with said head water jackets and a return jacket portion communicating with said coolant return passages and communicating with said head water jackets at a position spaced from said supply jacket portion, and wherein said supply jacket portion and said return jacket portion, with superposed portions surrounding substantial halves of the cylinder bores, are formed in the cylinder barrels having the cylinder bores arrayed in the axial direction of the crankshaft and a plurality of supply and return branch passages, which connect the regions of said supply jacket portion and said return jacket portion that correspond to the cylinder bores to said coolant supply passages and said coolant return passages are disposed in the crankcase and the cylinder barrels at each cylinder bore.

2. The engine cooling structure according to claim 1, wherein said cylinder barrels and said cylinder heads are integrally formed by mutually joining said cylinder water jackets and said head water jackets.

3. The engine cooling structure according to claim 1, wherein said cylinder barrels and said cylinder heads are integrally formed by mutually joining said cylinder water jackets and said head water jackets.

4. The engine cooling structure according to claim 2, wherein rod members dividing ring-shaped cavities, which are defined in said cylinder barrels in surrounding relation to said cylinder bores in a casting process, halfway into said supply and return jacket portions are fitted into cylinder barrels from the cylinder heads.

5. The engine cooling structure according to claim 3, wherein rod members dividing ring-shaped cavities, which are defined in said cylinder barrels in surrounding relation to said cylinder bores in a casting process, halfway into said supply and return jacket portions are fitted into cylinder barrels from the cylinder heads.

6. The engine cooling structure according to claim 2, and further including at least one supply branch passage being in communication with said coolant supply passages and said cylinder water jackets for supplying coolant thereto.

7. The engine cooling structure according to claim 2, and further including at least one return branch passage being in communication with said coolant return passages and said cylinder water jackets for returning coolant therefrom.

8. The engine cooling structure according to claim 2, wherein a pair of water pumps are provided and a pair of coolant supply passages operatively connected to individual water pumps for guiding the coolant from the respective water pump.

9. An engine cooling structure comprising:

a crankcase;

cylinder barrels having cylinder bores formed in the crankcase;

cooling cylinder jackets being formed in the cylinder barrels and surrounding the cylinder bores;

a crankshaft rotatably supported within the crankcase;

cylinder heads having head jackets being in communication with the cylinder jackets, said cylinder heads being coupled to the cylinder barrels with combustion chambers defined between the cylinder heads and the cylinder barrels with pistons slidably fitted in the cylinder bores with top ends facing the combustion chambers;

at least one pump for circulating a coolant between the cylinder jackets and the head jackets;

coolant supply passages formed in said crankcase for guiding the coolant from said pump;

coolant return passages formed in said crankcase for guiding the coolant from the cylinder jackets;

said coolant supply passages and the coolant return passages extending substantially parallel to the axis of said crankshaft with the axes of said cylinder bores being disposed therebetween and said cylinder jackets and said head jackets are formed such that the coolant supplied from said coolant supply passages returns from said cylinder jackets through said head jackets to said cylinder jackets, wherein said cylinder jackets are formed in said cylinder barrels for being divided into a supply jacket portion communicating with said coolant supply passages and communicating with said head jackets and a return jacket portion communicating with said coolant return passages and communicating with said head jackets at a position spaced from said supply jacket portion, and wherein said supply jacket portion and said return jacket portion, with superposed portions surrounding substantial halves of the cylinder bores, are formed in the cylinder barrels having the cylinder bores arrayed in the axial direction of the crankshaft and a plurality of supply and return branch passages, which connect the regions of said supply jacket portion and said return jacket portion that correspond to the cylinder bores to said coolant supply passages and said coolant return passages are disposed in the crankcase and the cylinder barrels at each cylinder bore.

10. The engine cooling structure according to claim 9, wherein said cylinder barrels and said cylinder heads are integrally formed by mutually joining said cylinder jackets and said head jackets.

11. The engine cooling structure according to claim 9, wherein said cylinder barrels and said cylinder heads are integrally formed by mutually joining said cylinder jackets and said head jackets.

12. The engine cooling structure according to claim 10, wherein rod members dividing ring-shaped cavities, which are defined in said cylinder barrels in surrounding relation to said cylinder bores in a casting process, halfway into said supply and return jacket portions are fitted into cylinder barrels from the cylinder heads.

13. The engine cooling structure according to claim 11, wherein rod members dividing ring-shaped cavities, which are defined in said cylinder barrels in surrounding relation to said cylinder bores in a casting process, halfway into said supply and return jacket portions are fitted into cylinder barrels from the cylinder heads.

14. The engine cooling structure according to claim 9, and further including at least one supply branch passage being in communication with said coolant supply passages and said cylinder jackets for supplying coolant thereto.

15. The engine cooling structure according to claim 9, and further including at least one return branch passage being in communication with said coolant return passages and said cylinder jackets for returning coolant therefrom.

16. The engine cooling structure according to claim 9, wherein a pair of pumps are provided and a pair of coolant supply passages operatively connected to individual pumps for guiding the coolant from the respective pump.

* * * * *